US008151678B2

(12) United States Patent
Mah et al.

(10) Patent No.: US 8,151,678 B2
(45) Date of Patent: Apr. 10, 2012

(54) SAFETY MANDOLIN SLICER

(75) Inventors: Pat Y. Mah, Kowloon (HK); Alexander Joshef Kalogroulis, Coulsdon (GB); Kwong Keung Tung, Kowloon (HK); Michael Ng, Adelaide (AU)

(73) Assignee: Daka Research Inc. (Br. Virg. Isl Corp.), Tortolla (VG)

( * ) Notice: Subject to any disclaimer, the term of this patent is extended or adjusted under 35 U.S.C. 154(b) by 427 days.

(21) Appl. No.: 12/386,426

(22) Filed: Apr. 17, 2009

(65) Prior Publication Data

US 2010/0263514 A1 Oct. 21, 2010

(51) Int. Cl.
*B26D 7/22* (2006.01)
*B26D 7/26* (2006.01)
*B26D 1/02* (2006.01)

(52) U.S. Cl. ..... 83/397; 83/699.51; 83/703; 83/856; 83/DIG. 1

(58) Field of Classification Search ..... 83/856, 83/DIG. 1, 717, 406.1, 699.51, 699.61, 719, 83/703, 49, 435.15, 437.7, 397, 399, 715, 83/865, 404.3; 241/168–169, DIG. 17, 95; D7/673, 693, 678
See application file for complete search history.

(56) References Cited

U.S. PATENT DOCUMENTS 2,286,177 A * 6/1942 Fabian ..... 83/699.61
2,766,793 A * 10/1956 Duszynski ..... 83/699.51
4,038,892 A * 8/1977 Popeil ..... 83/874
4,120,089 A * 10/1978 Borner ..... 30/278
4,573,387 A * 3/1986 Denter et al. ..... 83/856
4,624,166 A * 11/1986 Kreth et al. ..... 83/699.51
6,082,645 A * 7/2000 Himmighofen et al. ..... 241/168
6,694,578 B1 * 2/2004 Nicoll ..... 24/645
7,712,402 B2 * 5/2010 Ishii ..... 83/13
2007/0137457 A1 * 6/2007 Botsai et al. ..... 83/858
2008/0257128 A1 * 10/2008 Reimann et al. ..... 83/699.61
2009/0183611 A1 * 7/2009 Khubani ..... 83/13

FOREIGN PATENT DOCUMENTS

DE 9201765 * 12/1992
EP 1537962 * 6/2005

OTHER PUBLICATIONS

EP1,537,962 tranlation, Jun. 2005; Ihlow, Kerstin, B26B03/04.*
DE9201765 tranlation; Dec. 1992; Fackelmann GmbH B26D 1/02.*

* cited by examiner

*Primary Examiner* — Laura M. Lee
(74) *Attorney, Agent, or Firm* — Curtis L. Harrington; Harrington & Harrington

(57) ABSTRACT

A board shaped mandolin slicer includes a folding leg for stability in an angled orientation, and a "dead mans handle" for to enable exposure of the blade and adjustable thickness slicing only upon actuation of the handle. In addition, a spring resist in the handle is used in conjunction with a mechanical position guide limiting switch and angled cam which allows the user to better control the degree to which a platform move forward to expose the front of a main blade, to thus adjust the thickness of the slices uniformly. An additional child safety feature includes a pair of buttons on either side of the housing which need to be urged inwardly at the same time to unlock the mandolin slicer.

15 Claims, 6 Drawing Sheets

SAFETY MANDOLIN SLICER

FIELD OF THE INVENTION

The present invention relates to an improvements in the safety and use of a mandolin slicer and more particularly to safety features in a simple mandolin device including a "dead man handle" which works with at least one of a dropping platform or a blade barrier, as well as a child resistant lock to protect, respectively, users and children.

BACKGROUND OF THE INVENTION

The traditional mandolin slicer which has been commercially available for several decades typically has a sliding board over which is mounted a blade which lies parallel to the sliding board which can produce sliced food by pushing the food to be sliced across the blade. Generally the dimension of the blade above the sliding board determines the thickness of cut. The mandolin board is used to quickly produce a number of slices of even thickness. The user typically controls the food as it is sliced and food stabbing devices are often used to protect the user's hands.

Another problem with many mandolin slicers is the problem of prevention of movement during use. Many free standing mandolin slicers can move during use because even though they may be free-standing, they don't have structures which enable the users to grasp them securely. When a conventional slicer moves it can slide away, tip over and tumble.

Further, conventional mandolin slicers have their cutting blades constantly exposed, whether or not the slicer is in use. Any inadvertent contact with the blade, during the time when the slicer is deployed or when being stored and retrieved is a significant danger. Young adults and children who are not aware of the danger of an exposed blade are especially at risk. Many mandolin slicers have a locked position in which the platform is raised to a locking position at the same level as the cutting edge of the blade (or slightly higher). This means that if the slicer is handled there is no chance of the user accidentally slicing their finger or hand. However to resume slicing, the user must unlock the platform so that it can return to a position that allows the blade to slice the food. If the user is using the product and suddenly called away, for example to answer the telephone, the blade remains unguarded. Another person, maybe a child, may touch the slicer and suffer a serious cut as a consequence. This is because locking must be done specially as well as unlocking.

The utility value of a mandolin slicer depends upon its safety, simplicity and ease of use. For safety, any steps which protect injury during use and after use are very important. Simplicity is important, since a complicated device with many features which occupy a significant volume can complicate cleaning and maintenance. Ease of use is another important factor. The mandolin should be quickly deployable, easy and simple to use, and after use, have a structure which is quickly and easily washable, and quickly stowable to a storage position.

SUMMARY OF THE INVENTION

A board shaped mandolin slicer includes a folding leg to stably enable the slicer to assume a stable angled orientation. The mandolin slicer includes a front platform having a front end and a rear end, with the rear end of the front platform adjacent and slightly above a front cutting end of a blade. The invention consists of a mandolin slicer with a "dead mans handle". If the user wants to use the product, a spring loaded handle is squeezed which will automatically expose the blade by either allowing the platform to lower away. If a user were to releases their grip on the handle, the platform or barrier return to their position in front of the cutting edge of the blade thereby returning the product to a safe mode. It is further possible to add a child resistant lock that would stop a young child managing to operate the "dead man's handle" even if the child were strong enough to operate the spring opposed handle.

So, any time that a user leaves the mandolin slicer and is not clutching a spring loaded handle, the mandolin slicer is in a safety position in which the rear of the front platform covers the front of the blade and insures that any object moving toward the blade is isolated from the blade and is forced to pass over the protected front end of the blade. Also, while in this position the underside of the blade is protected due to a very close and possibly touching relationship of one end of the cam face, and such that it would be nearly impossible to place any object in front of the blade and thus nearly impossible to be cut by the blade even from the underside of the mandolin slicer.

The use of the mandolin slicer can only be accomplished by placing one hand on the grip actuator. This mechanism insures that the only time the blade is exposed is during use, and that it automatically causes the user to have a very good and stable grip on the overall mandolin slicer to eliminate the possibility that a user could lose control of it.

In terms of mechanics, a handle includes a spring resist grip actuator which causes a front edge of a front platform to move toward the handle to instantly place the mandolin slicer in a position for use. Aside from providing a slicer where the blade is protected during non-use, the force needed to overcome the spring is strong enough that very small children will be unlikely to be able manipulate the front platform forward to expose the cutting blade. In addition, the spring resist is used in conjunction with a mechanical position guide limiting switch which allows the user to limit the degree to which the front edge of a front platform to move toward the handle to thereby limit the spacing between the rear side of the front platform and the front of the blade, to thus limit the thickness of the slices.

The user can, by determining the degree to which the spring loaded handle is squeezed, also instantly control the slice thickness. So, without the mechanical position guide limiting switch, the user is free to make slices of varying thickness by controlling the squeeze of the handle. However, most mandolin slicer users want uniform sized slices. The mechanical position guide limiting switch is there so that the user will have a "stop" against which to squeeze, so that the user doesn't have to precisely control a manual grip of the spring loaded handle. In essence the mechanical switch will be enabled to allow the user to squeeze the spring loaded handle to different depths, with the user's only needed control aspect being to simply make physically sure that the handle is squeezed to an extent that it remains securely displace against one of the internal stops controlled by the mechanical position guide limiting switch. In order to allow the user to select the thickness of a slice, it is normal to adjust the height of the platform relative to the blade edge. By linking the height adjustment of the platform to the degree to which the "dead man's handle" is squeezed, it is possible to have the blade edge exposed by varying amounts thereby allowing the thickness of the slice to be adjusted according to the displacement of squeeze. By using adjustable stops, the user can simply move the adjustable stop to the selected position and squeeze the handle fully. The platform will move away from the blade and drop down to the selected position allowing accurate and repeatable slicing.

Once the mechanical position guide limiting switch is set to a position, actuation of the spring opposed handle will move the front platform forward to a limited position which corresponds to both physical separation of the front platform from the blade and a reduced elevation of the front platform with respect to the blade (due to the action of the cam face at the back end of the front platform acting against the support shaft). The mechanical position guide limiting switch can be configured to perform a locking function by disabling the ability of a user to displace the front platform at all. This position will prevent the blade from becoming uncovered even if the spring urged handle is pulled or squeezed.

Alternatively, and in addition to the locking function of the mechanical position guide limiting switch, two locking buttons may also be provided through holes in the main housing to lock whenever the front platform is brought to a position to rest over and cover the blade. Thus, it will close two side locks whenever it is left unattended. Two buttons, one on each side of the housing, would provide a child resistant feature as both buttons would need to be urged inwardly at the same time, while the other hand operates the grip, in order to open the mandolin slicer. The two buttons could be depressed to unlock the front platform fairly easily with an adult's hand, whereas a child's hand would have considerable difficulty. Therefore, a child would have to find a way to close both side buttons to unlock, insure that the mechanical position guide limiting switch is unlocked, and then while holding both side buttons, begin to actuate the spring loaded handle to begin to open the space in front of the main blade.

An adjustable julienne multi blade structure may be provided through the front platform in front of the blade. A series of cutting members supported by a rotatable member is easily deployed in front of the horizontal main blade. The rear side of the front platform is lowered so that the julienne blades assume a height in front of the main horizontal blade which is proportional to the depth of cut to be made by the main horizontal blade. In this configuration, the blades will not exceed the thickness of cut to be made by the main blade. Further, any device which is used to push food and which depends upon the upper rails of the board will not tend to touch the julienne blades.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
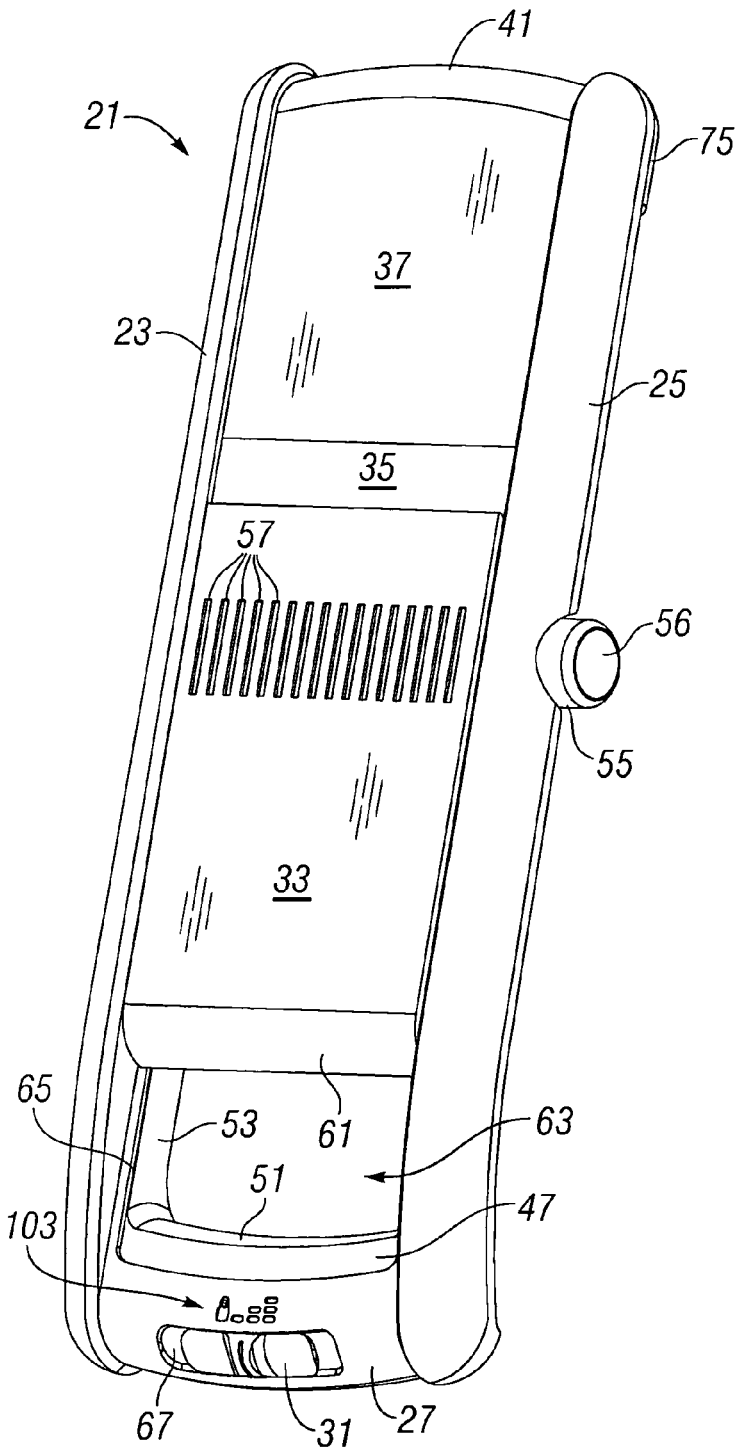
FIG. 1 is a perspective drawing of the upper surface of the mandolin slicer to facilitate a brief introduction of the names and orientation of the main components of the slicer, and shown with the folding leg in stowed position.

The description and operation of the mandolin slicer of the invention is best begun with reference to FIG. 1 which illustrates a perspective drawing of the upper surface of a mandolin slicer 21 to facilitate a brief introduction of the names and orientation of the main components. Mandolin slicer 21 has a pair of side rails, including a left side rail 23 and a right side rail 25. The side rails 23 and 25 may be joined by an end handle 27. Side rails 23 and 25 and end handle 27 may be formed simultaneously.

The end handle 27 may have a mechanical switch 31 to set the cutting height between a front platform 33 and a cutting blade 35. In the view of FIG. 1, the front platform 33 slightly overlies the front edge (not seen in FIG. 1) of handle upper portion of the slicer, and is shown with the folding leg in stowed position. Considering the end handle 27 to be the front end of the mandolin slicer 21, to the rear of the cutting blade 35 is a rear platform 37 which is seen to have a curved portion 41.

The end handle 27 has a number of symbols 43 printed above the mechanical switch 31 which include a picture of a pad lock, adjacent a number of columns having one rectangular symbol, two rectangular symbols and three rectangular symbols. These symbols correspond to and show that the mechanical setting of the mechanical switch 31 can be set to allow the front platform 33 and a cutting blade 35 to be set to a locked position as shown, or can assume a position where front platform 33 is gradually separated away from cutting blade 35 in graduated degrees in order to produce a graduated cutting slot just in front of the cutting blade 35, as will be shown in greater detail in subsequent drawings.

A spring loaded handle 47 includes a grip portion 51 and a guide rail portion 53, of which only a left guide rail portion 53 is observable in FIG. 1. When gripped and when force is applied to cause the grip portion 51 to move toward the end handle 27, the portion of the spring loaded handle 47 seen will move into the end handle 27, and the front platform 33 will move toward the end handle 27. Before or after this compressive movement has occurred, and to limit the distance the grip portion 51 can be drawn into end handle 27 to limit the movement of the front platform 33 away from the blade 35 the mechanical switch 31 can be moved to a limit position. By limiting the movement of the front platform 33 away from the blade 35 the user can have a controlled, consistent limitation on the cutting thickness without having to keep the user's hand under exactly displacement control.

Also seen on the right side of the mandolin slicer 21 is a julienne control knob 55, having a covering end cap 56. Julienne control knob 55 controls a series of blades (not shown in FIG. 1) which can be raised through a series of julienne blade slots 57 which are formed into front platform 33. A separation is seen between the julienne blade slots 57 and the blade 35 of about the same distance as the length of the julienne blade slots 57. Turning the julienne control knob 55 will deploy the blades (not seen), each one in its associated julienne blade slot 57.

Other details seen include a curving portion 61 of the front platform 33, and an upper handle guide rail 65 in which slidably supports guide rail portion 53 of spring loaded handle 47 from the upper side. Curving portion 61 of the front platform 33 is adjacent an opening 63 between curving portion 61 and the grip portion 51. Mechanical switch 31 is seen operating as a side to side slide switch within a depression 67 to provide stable, protected, controlled movement for the mechanical switch 31. A leg and notch fixture 75 is also partially seen at the underside of the right side rail 25 at the end opposite end handle 27.

Figure 2:
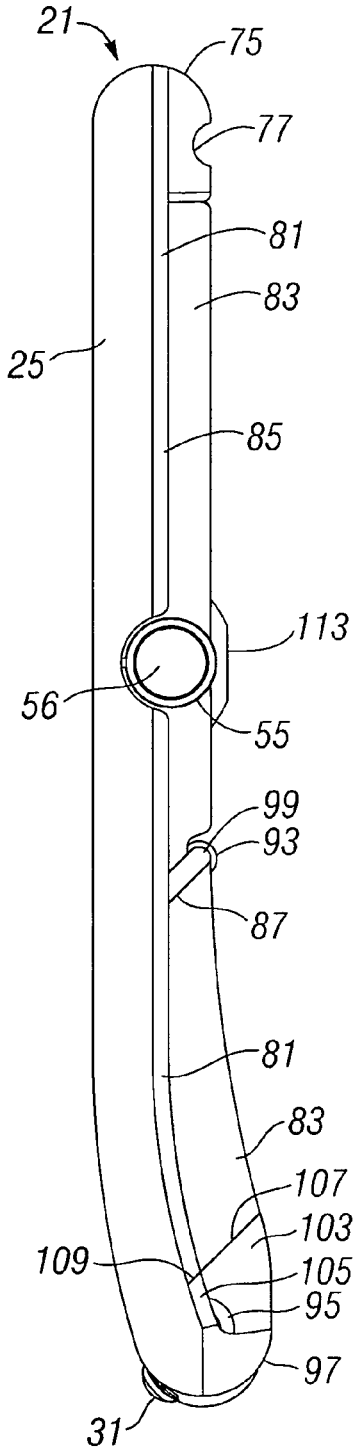
FIG. 2 is a side view roughly corresponding to the overall view seen in FIG. 1 shown to emphasize the exterior simplicity, and portability, stowability and ease of use.

Referring to FIG. 2, a side view roughly corresponding to the overall view seen in FIG. 1 shown to emphasize the exterior simplicity, and portability, stowability and ease of use of the mandolin slicer 21. Leg and notch fixture 75 is seen to have a notch 77 for resting the mandolin slicer 21 on the edge of a bowl or pan. Leg and notch fixture 75 may be made of a soft, non-skid material to stabilize the mandolin slicer 21 whether supported by a flat surface or pan or bowl. The underside of right side rail 25 (and left side rail 23 although not seen in FIG. 2) is seen as having a less recessed, downwardly projecting outer wall 81 and a more recessed, downwardly projecting inner wall 83. The space between the outer wall 81 and inner wall 83 form a channel 85. The channel 85 is utilized to partially accommodate a fold down leg angled member 87. As can be partially seen, is a fold down leg angled member 87 which is attached to a bar portion 91 which may be covered in a soft elastomeric member 93 for non-skid support when the mandolin slicer 21 is supported by its own folding leg assembly (not yet completely seen).

Near the bottom of FIG. 2, on the end of the mandolin slicer 21 nearest the mechanical button 31, a leg bushing 95 is seen inboard of outer wall 81 and outboard of inner wall 83. The leg bushing 95 engages the leg and assists its pivot action. A leg bushing securing member 97 has walls to match outer wall 81 and inner wall 83, including an inner wall 103 and an outer wall 105. A slanted joining line 107 is seen between the inner walls 103 and 83, while a very abbreviated slanted joining line 109 is seen between the outer walls 81 and 105. To the right of julienne control knob 55 is a julienne blade guard 113 which guards against inadvertent manual contact with the julienne blades (not yet seen), especially in their stowed position.

Figure 3:
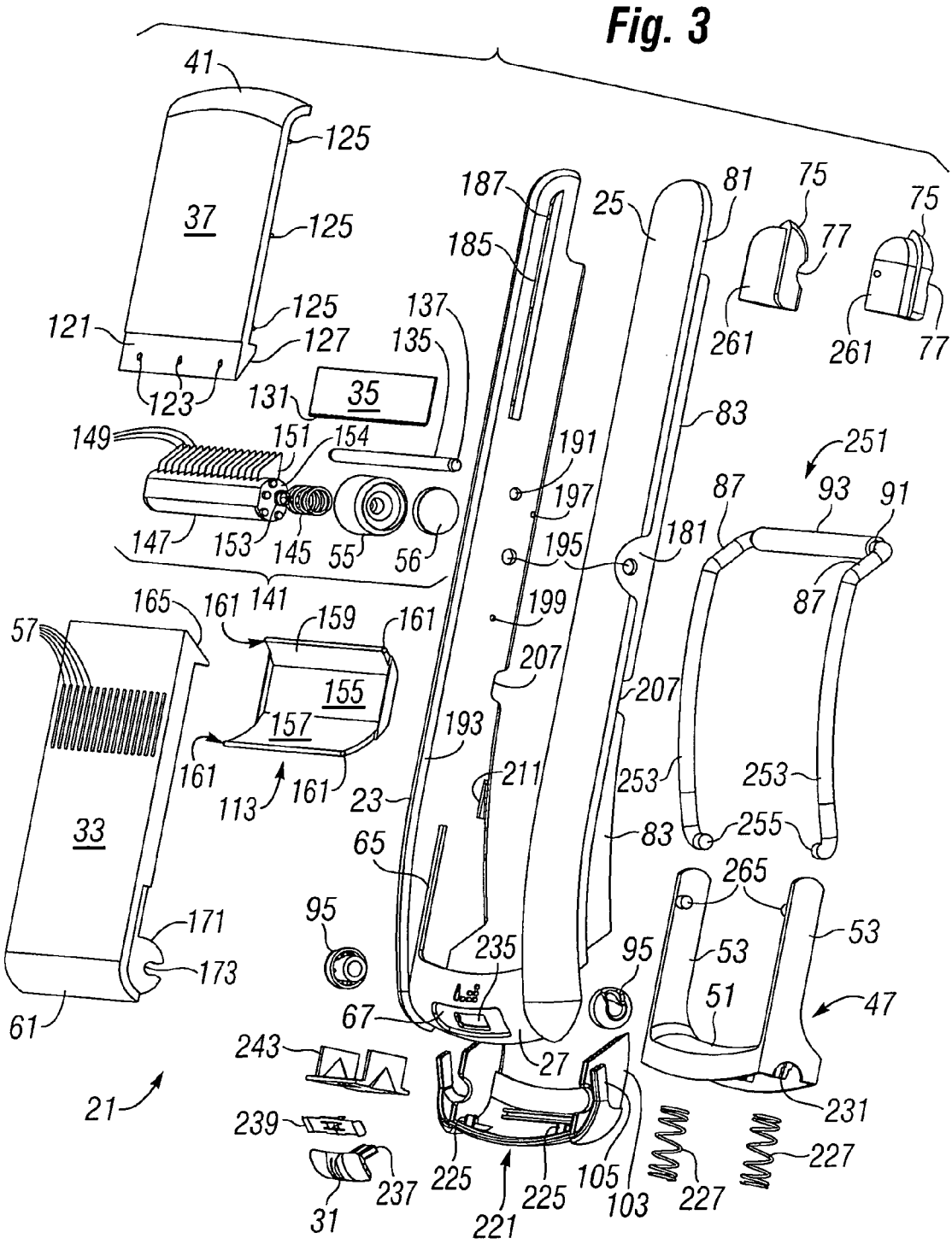
FIG. 3 is an exploded view of the mandolin slicer seen in FIGS. 1-2 and in which the components are further identified and the details and relationship of assembly is more completely seen.

Referring to FIG. 3, an exploded view of the mandolin slicer 21 is see to better illustrate all of the components of the mandolin slicer 21 and their relationship with each other. At the upper left, the rear platform 37 is shown as having a recessed space 121 for accommodating the blade 35 so that in general the planar top of blade 35 will be generally even with the top surface of rear platform 37. A series of mounting apertures 123 or other structures. Partially seen at the underside of the rear platform 37 is a series of protrusions or locating pegs 125 are preferably ultrasonically welded to left and right side rails 23 and 25 to help further stabilize the rear platform 37. The underside of the recessed space 121 has an angled surface 127 to provide a more gentle exit for food sliced by blade 35 and to facilitate an unmolested orderly exit for the sliced portion of such food.

Shown to the right of the angled surface 127, the blade 35 is seen. Blade 35 has a sharpened front edge 131. Blade 35 may have structures on its underside or opposite side to that shown in FIG. 3 with will interfit with the mounting bores or apertures 123. In FIG. 3, just below the blade 35, a support shaft 135 is seen. Support shaft 135 connects between the left side rail 23 and right side rail 25 and forms a support for the camming action of the rear of the front platform 33. The support shaft 135 has a pair of reduced diameter portions 137 at each end, only one of which is clearly seen in FIG. 3, so that it can engage an aperture and be limited in its insertion into that aperture.

Below the support shaft 135, a julienne assembly 141 is seen. In addition to the control knob 55 and covering end cap 56, a friction spring 145 is seen. To the left of friction spring 145 a julienne blade support barrel 147 supports a series of evenly spaced julienne blades 149. The julienne blade slots 57 should be able to accommodate the julienne blades 149 over the range of translation and elevation changes which the front platform 33 is capable. The spacing of the julienne blades 149 are spaced to correspond to the spacing of the julienne blade slots 57 of the front platform 33. The orientation of the julienne blades 149 are the same as they would appear through the julienne blades slots 57, with the rear of the blades having a flat edge 151 which would be supported by the end of the julienne blades slots 57 nearest the main blade 35 as seen in FIG. 1. Julienne blade support barrel 147 has a pair of projections 153, only one of which is seen an partially obscured by spring 145. The friction spring 145 will surround the projection 153 on one side and is used so that some frictional stability is added to the supported julienne blade support barrel 147 so that when the julienne blades 149 are raised they will not inadvertently tip down and so that when the julienne blades 149 are in the down position, they will not be inadvertently raised. Further, projection 153 is surrounded by a series of detent projections 154 which may be on one side only of the julienne blade support barrel 147 and interact with matching structure on the inside of right side rail 25 (not shown) so that the julienne blade support barrel 147 may be selectably set at a number of stable positions. This is but one of many ways that the julienne blade support barrel 147 may be pivotally fixed in a stable position.

Seen below the julienne assembly 141 is the julienne blade guard 113. Julienne blade guard 113 has a three sided structure including a base 155, longer front wall 157 and shorter rear wall 159. A pair of side walls 116 cover the sides of the portion of the julienne blade guard 113 which extend slightly below the more recessed, downwardly projecting inner wall 83 on each of the left and right side rails 23 and 25.

Near the upper corners of the longer front wall 157 and the shorter rear wall 159, a lateral projection 161 is seen, but only on the lateral side facing the viewer. The projections 161 on the opposite sides are not clearly seen and are indicated by arrows.

To the left of the julienne blade guard 113, the front platform 33 is again seen. Some details of the underside are seen including a front cam face 165 which is positioned to engage the support shaft 135. As front cam face 165 engages the support shaft 135, the support shaft 135 supports the rearward side of the front platform 33. When the front platform 33 is moved slightly forward, toward the end handle 27, the rear end of the front platform 33 most closely adjacent the blade 35 is allowed to both move forward and downward by the action of the front cam face 165. Movement of the front platform 33 toward the blade 35 causes the rear end of the front platform 33 to move upward as it approaches the blade 35, and preferably to a point that it meets but is slightly above the sharpened front edge 131 of the blade 35. This action of meeting at a point slightly above the front edge 131 of the blade 35 helps insure protection of the sharpened front edge 131 of the blade 35 as well as to protect users from inadvertent contact with sharpened front edge 131 of the blade 35.

Front cam face 165 may be planar to give a completely proportional action against the support shaft 135, but it can also be curved to produce a non-linear approach/displacement profile, such as an exponential drop away at the start of the displacement of the front platform 33. This causes the ability to make thicker slices to occur immediately upon opening of the mandolin slicer 21, but gives a finer adjustment range concentrating on the thicker slices. Conversely, it may cause the rear end of the front platform to drop slowly during the first portion of its travel and drop more steeply at the latter portion of its travel, to give a finer adjustment range concentrating on the thinner slices.

Further, the action of moving the platform 33 away from the blade 35 adjusts the height at which the sharpened front edge 131 of the blade 35 will engage a moving food mass. When the front platform 33 is in a forward position, the rear end of the front platform 33 will have moved down to enable the front edge 131 of the blade 35 to cut a moving food mass at a greater height above the front platform 33 to produce a thicker slice to be ejected during cutting below the angled surface 127. Conversely, when the front platform 33 is in a rearward position, the rear end of the front platform 33 will have moved upward to enable the front edge 131 of the blade 35 to cut a moving food mass at a lesser height above the front platform 33 to produce a thinner slice to be ejected during cutting below the angled surface 127 and underneath the mandolin slicer 21.

Front platform 33, underneath and adjacent curving portion 61, has a curved fitting 171 having a downwardly directed engagement opening 173. Curved fitting 171 and downwardly directed engagement opening are used to enable the grip portion 51 of the spring loaded handle 47 to exert forward motion, toward the end handle 27, upon the front platform 33.

As can be seen, the end handle 27 and the side rails 23 and 25 may be formed as a one piece unit. With the exception of an upward extension of the more recessed, downwardly projecting inner wall 83 to form an accommodation space 181, both of the insides of the side rails 23 and 25 are nearly identical. In the view of FIG. 3, many of the inside details of side rail 25 are identical to those of side rail 23 and those features of side rail 23 may be may be visible.

Side rails 23 and 25 each have a rear platform support rail 185 which may have a series of small blind bores 187 to interfit with the series of protrusions 125 of the rear platform 37. The rear platform support rails 185 support the rear platform 37 and insure that it will remain locked into place between side rails 23 and 25 and is preferably affixed by ultrasonic welding.

Forward of the a rear platform support rail 185 each of the side rails 23 and 25 have a shallow support shaft blind bore 191 into which will fit the reduced diameter portions 137 at each end of the support shaft 135.

Also seen is an inwardly disposed rim 193 which may be used as a limited overhang and against which the front platform 33 may be limited in its upward pivoting movement, and which may also serve to support and stabilize blade 35 and rear platform 37. Adjacent the shallow support shaft blind bore 191, each of the side rails 23 and 25 has a julienne blade support barrel bore 195 which will rotationally support projections 153 of the julienne blade support barrel 147 to pivot between a deployed and stowed position. Accommodation space 181 is adjacent julienne blade support barrel bore 195. Accommodation space 181 enables a closer connection of julienne control knob 55 to one of the pair of projections 153.

A pair of small blind bores 197 and 199 on each of the side rails 23 and 25 correspond to the lateral projections 161 on the julienne blade guard 113. The longer front wall 157 is supported between the small blind bores 197 and the shorter rear wall 159 is supported between the small blind bores 199.

A small slot 207 interrupts the more recessed, downwardly projecting inner wall 83 at a place where the bar portion 91 of the leg assembly (to be discussed) folds under the side rails 23 and 25. Closer to the end handle 27 and under the level of the upper handle guide rail 65, a lower handle guide rail 211 is present on both the side rails 23 and 25. Between the upper handle guide rail 65 and lower handle guide rail 211, the guide rail portion 53 of the spring loaded handle 47 is supported, guided and allowed to translate between the forward and rear positions smoothly.

A number of components are seen adjacent the end handle 27. A lower housing 221, during assembly, makes way for entry of the spring loaded handle 47, with its guide rail portions 53 slidably entered into the space between the upper handle guide rail 65 and lower handle guide rail 211. Lower housing 221 includes spring securing posts 225 which will engage springs 227. The other end of springs 227 engage spring engaging posts 231 at the front of the spring loaded handle 47. Thus, when the lower housing 221 is assembled in place, the spring loaded handle 47 is urged toward the blade 35 and away from the end handle 27.

On the end handle 27, the depression 67 is adjacent an access opening 235. The mechanical switch 31 is seen as having a lever 237 which will extend into the access opening 235. A clip 239 is slidably attached to the lever 237 after it is extended through the access opening 235 to hold it in place. A mechanical position guide limiting block 243 is engaged by the lever 237 and used to control the permitted position of the spring loaded handle 47 in the direction towards the end handle 27.

To the right of the right side rail 25, a full view of a leg assembly 251 is shown. In addition to the fold down leg angled member 87, bar portion 91, and soft elastomeric member 93, the angled member 87 is seen to be connected to a fold down leg curved member 253. The curved member 253 and straight member 71 join to form a single member and curve inward to a pair of terminations 255. These facing terminations 255 are inserted into the leg bushings 96. The placement of the Lower housing 221 causes the covering outer wall 105 to trap end terminations 255 within the leg bushings 96.

The leg and notch fixture 75 are each seen as having a plug insert portion 261 each of which are affixed into the far ends of the left and right side rails 23 and 25. On the inside of the guide rail portion 53, inward projections 265 are seen. The projections 265 will be engaged by the engagement opening 173 of the curved fitting 171. The engagement opening 173 may have a snap fit onto the projections 265.

Figure 4:
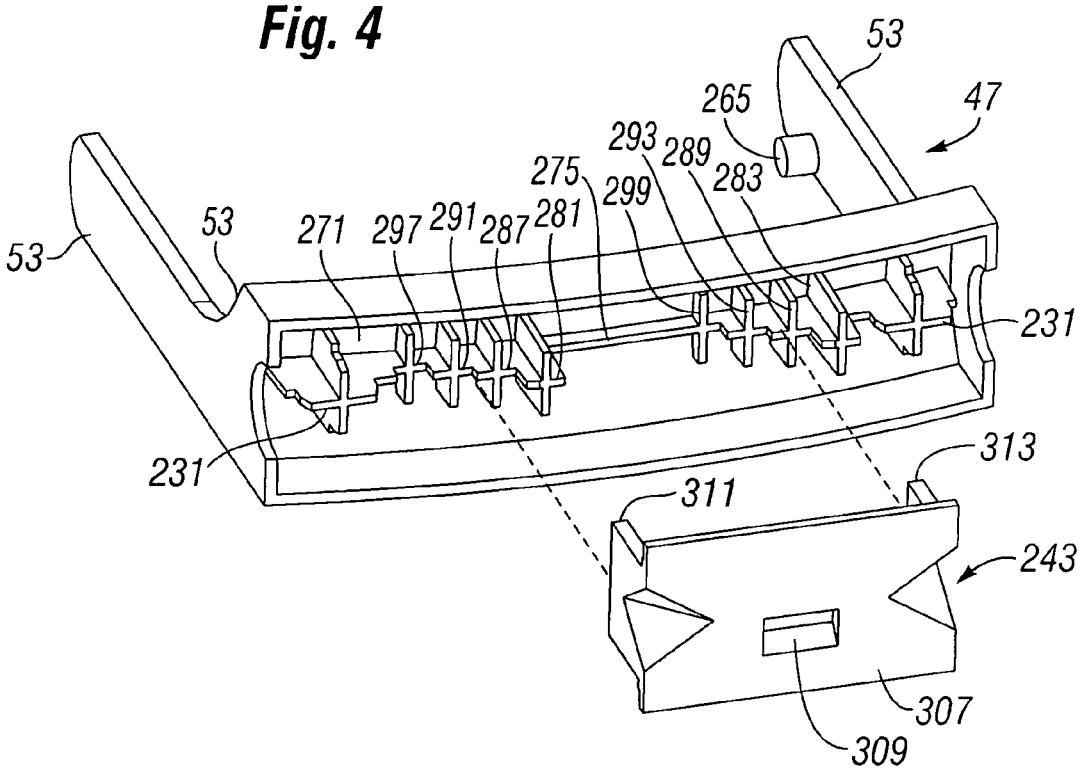
FIG. 4 is a front perspective view of the spring loaded handle with the mechanical position guide limiting block exploded away from to reveal details as a double series of cross shaped projections or stops from a back wall of the handle.

Referring to FIG. 4, a front perspective view of the spring loaded handle 47 with mechanical position guide limiting block 243 exploded away from it sufficient to see its details, reveals a number of structures. Aside from the two spring engaging posts 231 already seen, a series of cross shaped projections from a back wall 271 are horizontally joined by a common central horizontal projection 275. The central horizontal projection 275 is shared by the two spring engaging posts 231, and a number of projection areas from the back wall 271. The projections seen occur in pairs and include a first locking projection 281 and a second locking projection 283. The first and second locking projections 281 and 283 project farthest from the back wall 271 (disregarding the two spring engaging posts 231) and when mechanical position guide limiting block 243 is positioned in front of first and second locking projections 281 and 283, the spring loaded handle 47 cannot be compressed into the lower handle guide rail 211, and the front platform 33 cannot be urged away from the blade 35.

A first thinnest slice support projection 287 and a second thinnest slice support projection 289 are located adjacent the first and second locking projections 281 and 283 and have a displacement away from the back wall 271 of a lesser distance than the first and second locking projections 281 and 283. First and second thinnest slice support projections 287 and 289 enable spring loaded handle 47 to be slightly compressed into the lower handle guide rail 211, so that the front platform 33 is urged down and away from the blade 35 sufficient to produce the thinnest slices.

Adjacent first and second thinnest slice support projections 287 and 289, First and second medium slice support projections 291 and 293 enable spring loaded handle 47 to be compressed into the lower handle guide rail 211 about half of the maximum distance, so that the front platform 33 is urged down and away from the blade 35 sufficient to produce the medium thickness slices. Adjacent first and second medium slice support projections 291 and 293, first and second thickest slice support projections 297 and 299 enable spring loaded handle 47 to be compressed into the lower handle guide rail 211 to the maximum distance, so that the front platform 33 is urged down and away from the blade 35 sufficient to produce the maximum thickness slices.

The mechanical position guide limiting block 243 has a main plate 307 with a rectangular aperture 309 through which the lever 237 extends, in order to connect the mechanical position guide limiting block 243 to the mechanical switch 31 and enable the mechanical position guide limiting block 243 to move laterally with any lateral movement of the mechanical switch 31. Attached to the main plate 307 are a pair of spaced apart parallel engagement plates 311 and 313. The spacing of the spaced apart parallel engagement plates 311 and 313 is the same spacing between projections 281 and 283, projections 287 and 289, projections 291 and 293, and projections 297 and 299. These force bearing pairs help spread and stabilize the force resistance of the grip portion 51 against the mechanical position guide limiting switch 243, which is in turn supported, through its main plate 307 as main plate 307 bears against the inside of the lower housing 221. Other possibilities include greater multiples of the spaced apart parallel engagement plates 311 and 313, and corresponding multiples of the projections 281, 287, 291, and 297. A sloping, and therefore continuous surface would allow selection of an infinite number of thicknesses to be selected.

Figure 5:
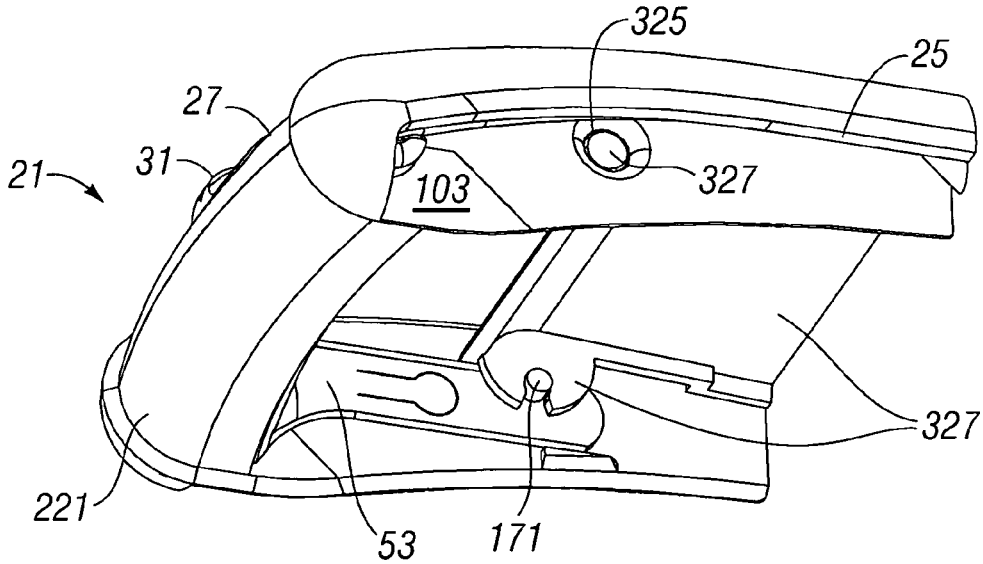
FIG. 5 is a perspective upward view of the underside of the mandolin slicer illustrating button locks which can be employed, in addition to the "dead man's handle" to even further child-proof the mandolin slicer.

Referring to FIG. 5, a perspective upward view of the underside of the mandolin slicer 21 nearest the end handle 27 illustrates one possible embodiment of the previously mentioned button locks. A button aperture 325 permits partial passage of a spring loaded button 327. As can be seen from the opposite side, the button 327 can be made of a cantilevered part of the material making up the guide rail portion 53 of the spring loaded handle 47. A keyhole cut about the cantilevered portion and its location in the guide rail portion 53 of the spring loaded handle 47 permits this feature to be added simply with a button aperture 325 and a substituted spring loaded handle 47.

Figure 6:
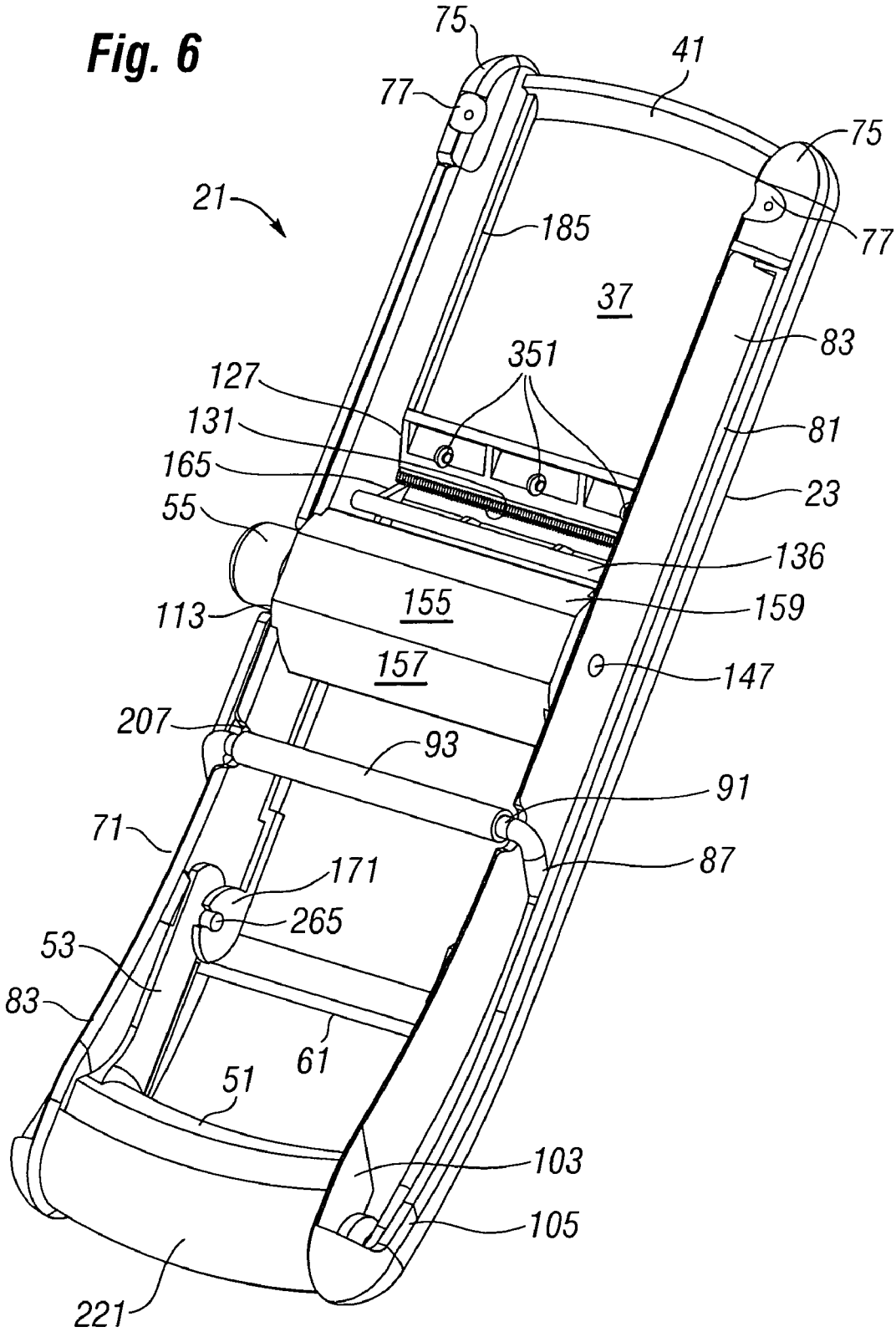
FIG. 6 is a perspective view of the underside of the mandolin slicer illustrating an overall view of the components and detail of structures.

FIG. 6 is a perspective view of the underside of the mandolin slicer 21 which illustrates a good overall view of the components and detail of structures best seen from a bottom view. A series of three rivets 351 are seen adjacent the angled surfaces 127 for holding the blade 35 in place. The notches 77 of each of the leg and notch fixtures 75 are seen as having a parallel orientation and are wide enough to accommodate either a linear or curved member placed between them.

Figure 7:
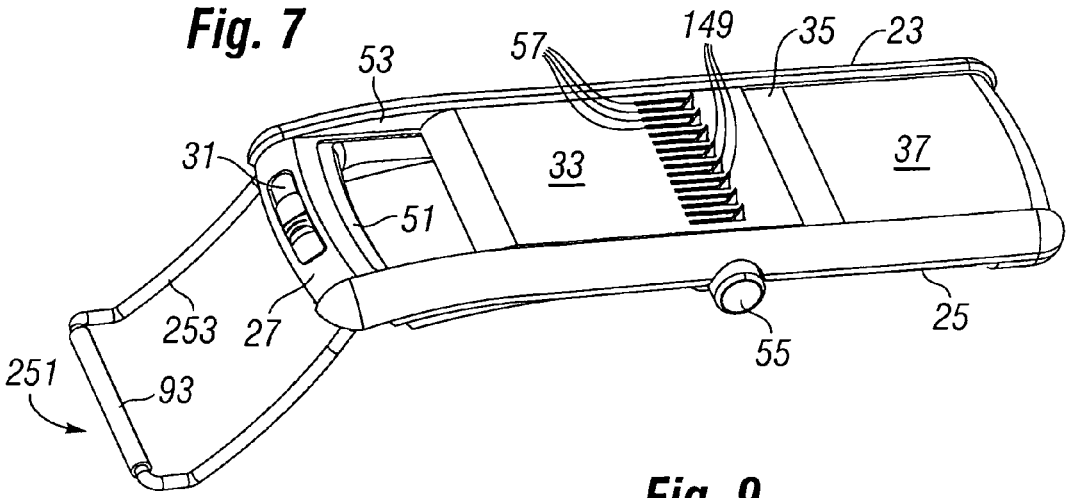
FIG. 7 a perspective view of the mandolin slicer seen in a deployed position ready for use with the leg assembly deployed and supporting the handle end of the slicer.

Referring to FIG. 7, a perspective view of the mandolin slicer 21 is seen in a deployed position ready for use. There is plenty of clearance for a user to set the mechanical switch 31, and bring the user's hand around the end handle 27 through the leg assembly 251. The user will likely bring their fingers around the grip portion 51 in order to urge it toward the end handle 27 to cause the front platform 33 to move away and down from the blade 35. While still grasping the end handle 27 and grip portion 51 together simultaneously the user can slice foods by sliding them along the front platform 33 and toward the main blade 35. The julienne blades 149 are also illustrated in the deployed position.

Figure 8:
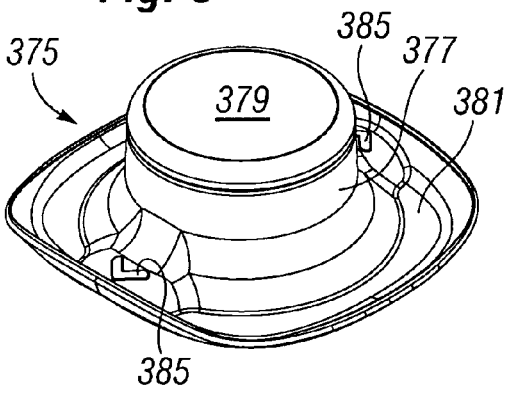
FIG. 8 is a perspective view from above of one possible embodiment of a food engaging pusher which may be used with the mandolin slicer of FIGS. 1-7.

Referring to FIG. 8, one possible embodiment of a food engaging pusher 375 is shown. The use of a food engaging pusher 375 is important for protecting the user's hand from any contact with either the main blade 35 or the julienne blades 149, especially when the mass of food being cut has a small remaining mass. The food engaging pusher 375 has a knob portion 377, upper cap 379 and an upwardly curved lower portion 381. The upwardly curve lower portion 381 may have a regular shape and thus may have some indicators such as arrows 385 to indicate the orientation for the user to use with the mandolin slicer 21.

Figure 9:
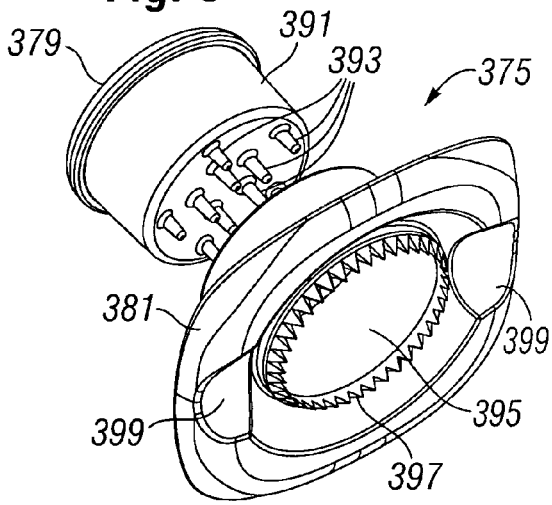
FIG. 9 is an exploded view of the food engaging pusher of FIG. 8 which illustrates a separate plug portion having a series of food engaging extensions and a base having a regularly triangularly jagged downwardly directed member.
Figure 10:
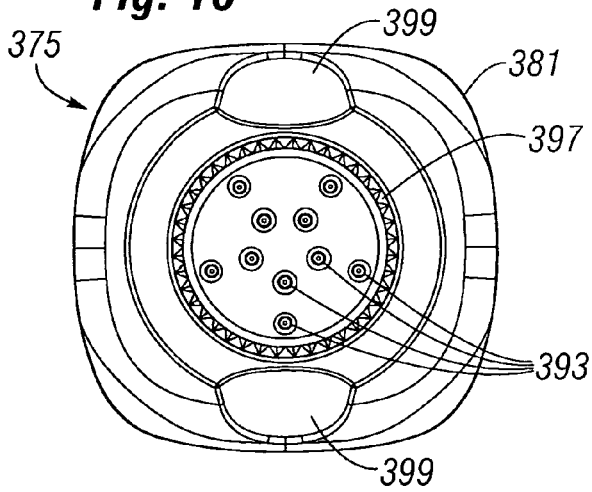
FIG. 10 illustrates a bottom plan view of the food engaging pusher of FIGS. 8-9.

Referring to FIG. 9, an exploded view of the food engaging pusher 375 shows that the cap 379 is part of a plug 391 having a series of food engaging extensions 393. The upwardly curved lower portion 381 has a bore 395, with the lower opening of the bore 395 having a regularly triangularly jagged downwardly directed member 397. A curved space 399 lies under the arrows 385 seen in FIG. 8. Referring to FIG. 10, a bottom view of the food engaging pusher 375 illustrates the overall shape and illustrates the structures which will engage a mass of food working together.

Figure 11:
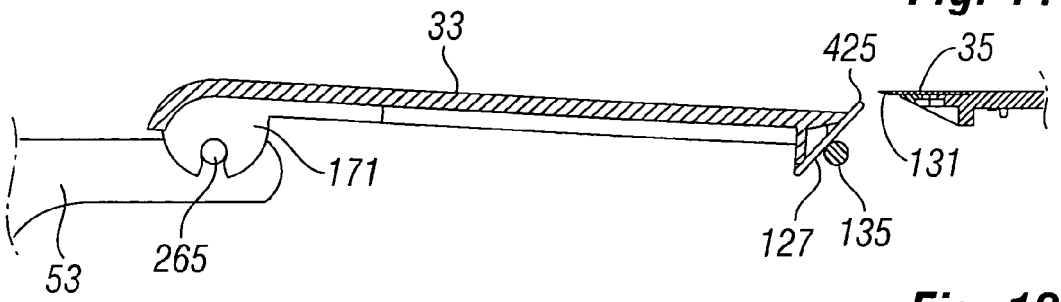
FIG. 11 is a closeup view of the end of the front platform showing an exaggerated view of blade guard which exceeds the height of the front platform.

Referring to FIG. 11, a closeup schematic side view of the end of the front platform shows an exaggerated view of a blade guard 425 which exceeds the height of the front platform 33. Here the end of blade guard 425 extends slightly above the surface of the front platform 33. The ramp effect will not significantly impact the slicing function, and the top of the blade guard 425 may simply include a slight upturn of the end of the front platform 33 to form the over coverage of the edge 131 of the blade 35. The blade guard 425 is shown as somewhat continuous with the angled surface 127 but it can be discontinuous with the angled surface 127.

Figure 12:
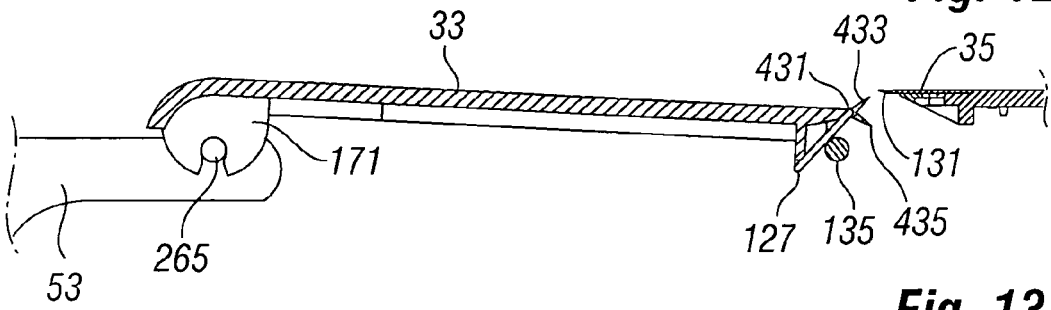
FIG. 12 illustrates a closeup view of the end of the front platform showing an exaggerated view of a "Y" shaped blade guard which has portions which will cover the exposed blade both above and below the edge of the blade.

Referring to FIG. 12 a closeup view of the end of the front platform showing an exaggerated view of a "Y" shaped blade guard 431 is seen. The "Y" shaped blade guard 431 is shown somewhat exaggeratedly, but provides an upper edge 433 which will rest over the edge 131 of blade 35 and a lower edge 435 which will rest under edge 131 of blade 35.

Figure 13:
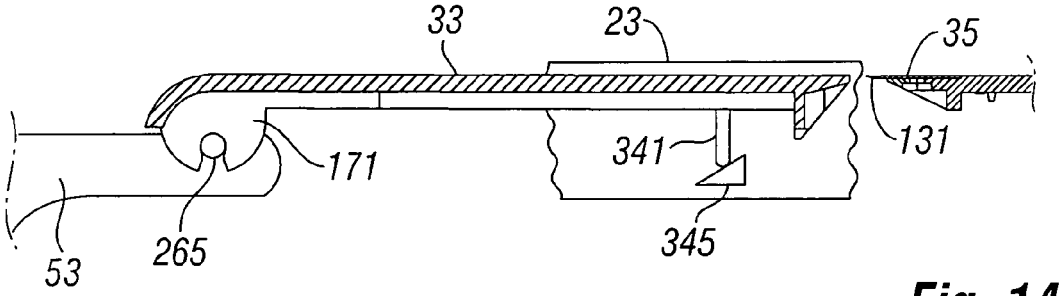
FIG. 13 illustrates a reversal of the location of the cam face seen as a structure supported by the side rails, with a cam follower provided as part of the front platform.

Referring to FIG. 13, a reversal of the location of the cam face 127 is seen where a cam follower member 341 is provided to work in conjunction with a cam member 345 which may depend from the left side rail 23. The cam member 345 may be formed integral with the left side rail 23 (not shown in FIG. 13) and it may only need to extend a centimeter or so beyond the inside surface of the left side rail 23 and thus can be inexpensively formed and made. The front platform 33 may still guard the front edge 131 of the blade 35 depending upon the manner in which the cam member 345 is set.

Figure 14:
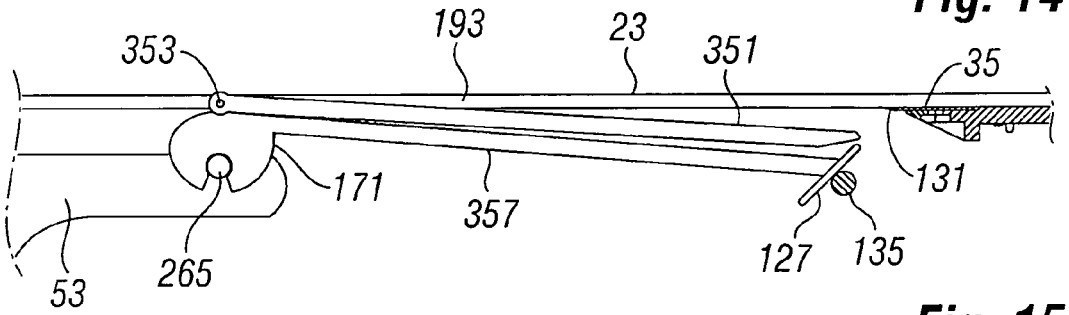
FIG. 14 illustrates an embodiment in which the front end of the front platform is pinned to the side rails and in which the handle operates a blade guard directly to pull the blade guard underneath the front platform to give the advantage of stability and the ability to have the blade guard move relative to the front platform.

Referring to FIG. 14, an embodiment in which a front end of a front platform 352 may have a pivot pin 353 or other pivot connection to the left and right side rails 23 and 25. A guard link 357 is connected to a combination blade guard and cam member 361, and to the curved fitting 171. The guard link 357 moves underneath the front platform 33 and in essence moves behind the edge of the front platform 352 which may then be positioned quite close to the front edge of the front edge of the blade 131.

Figure 15:
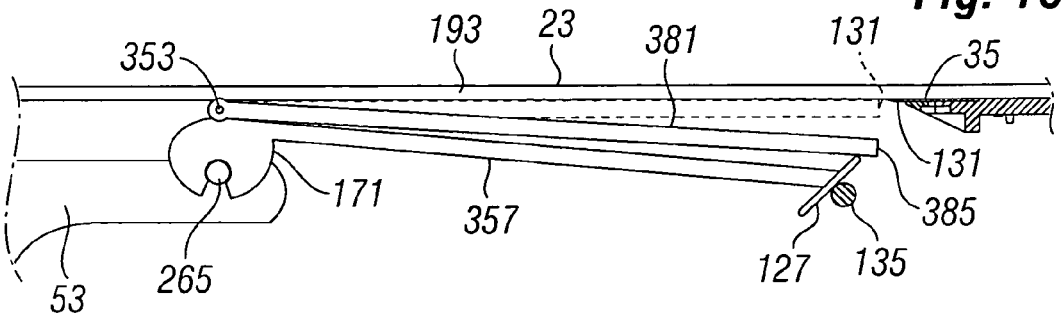
FIG. 15 illustrates an arrangement similar to that seen in FIG. 14, but where a cam member having a surface which cooperates with a support shaft which is moved farther toward its pivot point and where a platform is seen having a flattened end which has an arc of swing which brings it close to the front edge of the blade.

Referring to FIG. 15 an arrangement similar to that seen in FIG. 14 is illustrated, but where a cam member 127 is seen as having a surface which cooperates with a support shaft 135 which is moved farther toward its pivot point 353. A front platform 381 has a vertically broader end 385 which has the capability to provide a guarding extent both above and below the blade 35. FIG. 15 also illustrates that a range of placement for the cooperating cam members can occur along a broad length, from adjacent and under the blade 35 to a point much farther away from the blade 35. This also opens the possibility for a shorter displacement stroke for grip portion 51 which may translate into a mechanically advantaged lowering of the front platform 381. The flattened end 385 of the platform 381 has an arc of swing which comes close enough to the front edge 351 of the blade 35 to effectively isolate it from manual contact, but so close enough that any part of the flattened end 385 will touch front edge 351 of the blade 35.

While the present invention has been described in terms of a structure, device and process for a new mandolin slicer and which has high safety and ease of use characteristics; one skilled in the art will realize that the structure and techniques of the present invention can be applied to many structures and devices which are used in the kitchen, and particularly where ease of use, safety, and adjustability can be achieved in a single device.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A mandolin slicer comprising:

a frame housing including a first side rail and a second side rail each having a first end attached to an end handle member;

a front platform slidably supported between the first and second side rails, the front platform having a first end closer to the end handle than a second end;

a main blade supported between the first and second side rails having a cutting edge directed toward the handle member and opposed by the second end of the front platform;

a grip member linked to the front platform and displacable with respect to the frame housing to cause movement of the second end of the front platform away from the main blade as a grip actuator by a compressive grasping motion on the grip member toward the frame housing, the second end of the front platform automatically urged toward the main blade in absence of grip actuation by a compressive grasping motion;

a cam mechanism associated with the second end of the front platform such that slidable displacement of the front platform toward the handle member causes the second end of the front platform to assume a position below as well as away from the cutting edge of the main blade to create a controlled space through which food may be sliced and passed through.

2. The mandolin slicer as recited in claim 1 wherein the grip member is displaceable toward the end handle.

3. The mandolin slicer as recited in claim 1 wherein the front platform is pivotally supported adjacent the first end of the front platform, and wherein the grip member is translatably linked to the front platform adjacent pivotal support of the first end of the front platform.

4. The mandolin slicer as recited in claim 1 wherein said cam mechanism enables the second end of the front platform to move away from and below the cutting edge of the main blade.

5. The mandolin slicer as recited in claim 1 wherein the cam mechanism further comprises a support shaft extending between the pair of spaced apart side rails, and wherein the second end of the front platform includes a cam face which is supported by the support shaft and configured such that movement of the front platform toward the handle member causes the second end of the front platform to move away from and below the cutting edge of the main blade.

6. The mandolin slicer as recited in claim 1 wherein the cam mechanism further comprises a cam surface depending from at least one of the pair of spaced apart side rails, and wherein the front platform includes a portion for engaging the cam surface such that movement of the front platform toward the handle member causes the second end of the front platform to move away from and below the cutting edge of the main blade.

7. The mandolin slicer as recited in claim 1 and further comprising a spring interposed between the handle member and grip member to urge the grip member away from the handle member when the member is not being manually urged toward the handle member.

8. The mandolin slicer as recited in claim 1 wherein the frame housing has a first end and a second end, the first end nearer the end handle member than the second end and further comprising a leg assembly pivotally attached to the first end of the frame housing and pivotable to a deployed position at an angle to the frame housing and pivotable to a stowed position substantially parallel to the frame housing.

9. The mandolin slicer as recited in claim 1 wherein the grip member includes a pair of guide rail portions each adjacent and parallel to an associated one of the frame housing first and second side rails and includes a spring loaded button urged toward its associated one of the first and second side rails, and wherein the first and second side rails each have a button aperture which will be engaged by the spring loaded button when the grip member is in a farthest position from the end handle member.

10. The mandolin slicer as recited in claim 1 wherein the front platform has at least one opening for admitting at least one blade to be selectively deployed above the front platform, and selectively stowed below the front platform.

11. The mandolin slicer as recited in claim 1 wherein the at least one opening is a plurality of openings and where the blade is a plurality of blades, each blade having a separate associated opening.

12. The mandolin slicer as recited in claim 5 wherein the front platform is enabled to move slidably directly toward and partially cover the cutting edge of the main blade to form a blade guard, the second end of the front platform supported by the support shaft through the cam face.

13. The mandolin slicer as recited in claim 1 and further comprising a mechanical position guide limiting mechanism, associated with at least one of the first and second side rails, end handle, and grip member which selectably limits the degree to which grip member is slidably displaced toward the end handle to limit slidable displacement of the front platform member.

14. The mandolin slicer as recited in claim 1 wherein the front platform second end has an upward projection enabled to move partially over the cutting edge of the main blade and a downward projection enabled to move partially under the cutting edge of the main blade to form a two sided blade guard.

15. The mandolin slicer as recited in claim 1 and further comprising a spring interposed between the handle member and grip member, and wherein one of the handle member and the grip member is linked urge the front platform toward the cutting edge of the main blade when the member is not being manually urge toward the handle member.

* * * * *